US005882082A

United States Patent [19]

Moore

[11] Patent Number: 5,882,082

[45] Date of Patent: Mar. 16, 1999

[54] ADJUSTABLE FOOT REST

[76] Inventor: Robert C. Moore, 81 S. Brighton Ave., Upper Darby, Pa. 19082

[21] Appl. No.: 3,648

[22] Filed: Jan. 7, 1998

[51] Int. Cl.[6] ..... A47C 16/00

[52] U.S. Cl. ..... 297/423.44; 297/423.45; 297/423.46

[58] Field of Search ..... 297/440.1, 440.14, 297/423.39, 423.41, 423.44, 423.45, 423.46, 423.1; 248/558, 346.3, 157, 274.1

[56] References Cited

U.S. PATENT DOCUMENTS

| | | |
|---|---|---|
| 3,084,975 | 4/1963 | Winrow . |
| 3,505,994 | 4/1970 | Smith, Jr. . |
| 4,678,234 | 7/1987 | Wilson . |
| 5,094,505 | 3/1992 | Nichols . |
| 5,176,596 | 1/1993 | Ullman . |
| 5,184,987 | 2/1993 | Wilkinson . |
| 5,248,286 | 9/1993 | Wilkinson et al. . |
| 5,275,579 | 1/1994 | Wilkinson . |

FOREIGN PATENT DOCUMENTS

| | | |
|---|---|---|
| 3616970 | 11/1987 | Germany . |

*Primary Examiner*—Milton Nelson, Jr.

[57] ABSTRACT

An adjustable foot rest including a base portion having a generally rectangular configuration. The base portion has a bottom wall and a top wall. The base portion includes angled opposed long side walls and angled opposed short end walls. The long side walls and the short end walls are angled outwardly from the top wall to the bottom wall. A T-shaped portion is provided having a bottom wall and a top wall. The T-shaped portion has angled interior walls and vertically disposed exterior walls. The angled interior walls are angled outwardly from the top wall to the bottom wall. The T-shaped portion adjustably couples with the base portion. At least one L-shaped portion is provided having a bottom wall and a top wall and angled interior walls and vertically disposed exterior walls. The angled interior walls are angled outwardly from the top wall to the bottom wall. The L-shaped portion adjustably couples with the base portion.

4 Claims, 3 Drawing Sheets

ADJUSTABLE FOOT REST

BACKGROUND OF THE INVENTION

1. Field of the Invention

The present invention relates to an adjustable foot rest and more particularly pertains to creating a foot rest of various heights and angles with an adjustable foot rest.

2. Description of the Prior Art

The use of footrests is known in the prior art. More specifically, footrests heretofore devised and utilized for the purpose of allowing a person's feet a place to rest are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,318,489 to Irwin; U.S. Pat. No. 5,348,377 to Grosch; U.S. Pat. No. 5,302,003 to Xenofos; U.S. Pat. No. 4,678,234 to Wilson; U.S. Pat. No. Des. 353,636 to Le Roux; and U.S. Pat. No. 5,201,568 to Christensen, Jr.

While these devices fulfill their respective, particular objective and requirements, the aforementioned patents do not describe an adjustable foot rest for creating a foot rest of various heights and angles.

In this respect, the adjustable foot rest according to the present invention substantially departs from the conventional concepts and designs of the prior art, and in doing so provides an apparatus primarily developed for the purpose of creating a foot rest of various heights and angles.

Therefore, it can be appreciated that there exists a continuing need for new and improved adjustable foot rest which can be used for creating a foot rest of various heights and angles. In this regard, the present invention substantially fulfills this need.

SUMMARY OF THE INVENTION

In the view of the foregoing disadvantages inherent in the known types of footrests now present in the prior art, the present invention provides an improved adjustable foot rest. As such, the general purpose of the present invention, which will be described subsequently in greater detail, is to provide a new and improved adjustable foot rest and method which has all the advantages of the prior art and none of the disadvantages.

To attain this, the present invention essentially comprises a base portion having a generally rectangular configuration. The base portion has a bottom wall and a top wall. The base portion includes angled opposed long side walls and angled opposed short end walls. The long side walls and the short end walls are angled outwardly from the top wall to the bottom wall. The short end walls each have a pair of pegs extending upwardly therefrom. One of the long side walls has a peg extending upwardly therefrom at opposite ends thereof. A T-shaped portion is provided having a bottom wall and a top wall. The T-shaped portion has angled interior walls and vertically disposed exterior walls. The angled interior walls are angled outwardly from the top wall to the bottom wall. The angled interior walls each have peg receptacles extending therein for mating with the pegs of the base portion. At least one L-shaped portion is provided having a bottom wall and a top wall and angled interior walls and vertically disposed exterior walls. The angled interior walls are angled outwardly from the top wall to the bottom wall. The angled interior walls each have peg receptacles extending therein for mating with the pegs of the base portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable foot rest which has all the advantages of the prior art footrests and none of the disadvantages.

It is another object of the present invention to provide a new and improved adjustable foot rest which may be easily and efficiently manufactured and marketed.

It is a further object of the present invention to provide a new and improved adjustable foot rest which is of durable and reliable construction.

An even further object of the present invention is to provide a new and improved adjustable foot rest which is susceptible of a low cost of manufacture with regard to both materials and labor, and which accordingly is then susceptible of low prices of sale to the consuming public, thereby making such an adjustable foot rest economically available to the buying public.

Even still another object of the present invention is to provide a new and improved adjustable foot rest for creating a foot rest of various heights and angles.

Lastly, it is an object of the present invention to provide a new and improved adjustable foot rest including a base portion having a generally rectangular configuration. The base portion has a bottom wall and a top wall. The base portion includes angled opposed long side walls and angled opposed short end walls. The long side walls and the short end walls are angled outwardly from the top wall to the bottom wall. A T-shaped portion is provided having a bottom wall and a top wall. The T-shaped portion has angled interior walls and vertically disposed exterior walls. The angled interior walls are angled outwardly from the top wall to the bottom wall. The T-shaped portion adjustably couples with the base portion. At least one L-shaped portion is provided having a bottom wall and a top wall and angled interior walls and vertically disposed exterior walls. The angled interior walls are angled outwardly from the top wall to the bottom wall. The L-shaped portion adjustably couples with the base portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
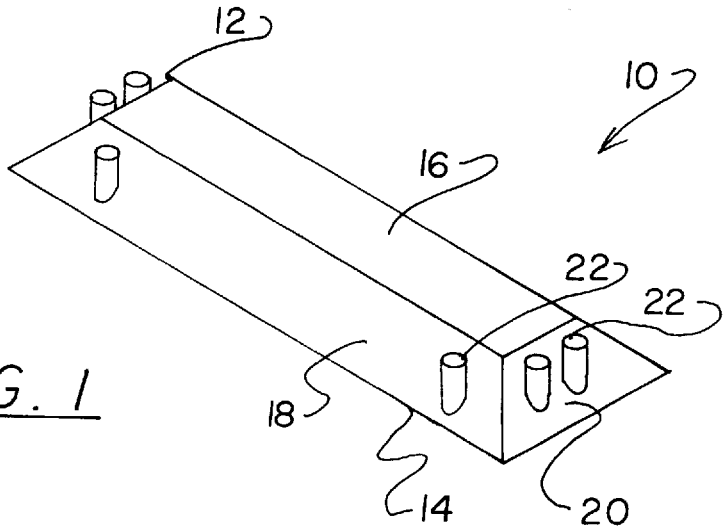
FIG. 1 is a perspective view of the preferred embodiment of the adjustable foot rest constructed in accordance with the principles of the present invention.
Figure 2:
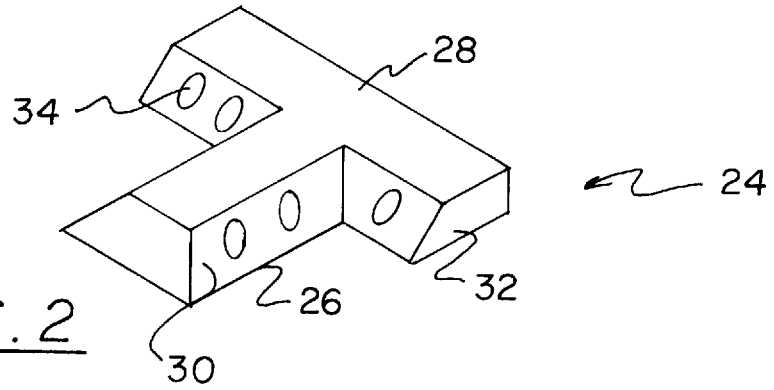
FIG. 2 is a perspective view of the T-shaped portion of the present invention.
Figure 3:
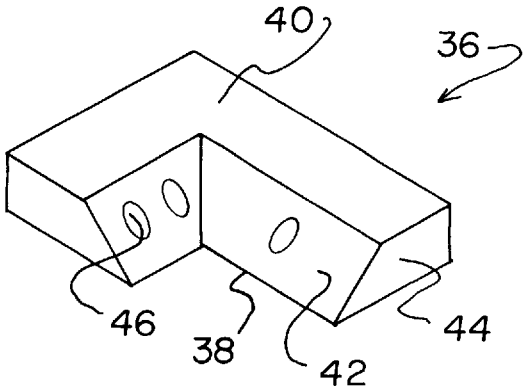
FIG. 3 is a perspective view of the L-shaped portion of the present invention.
Figure 4:
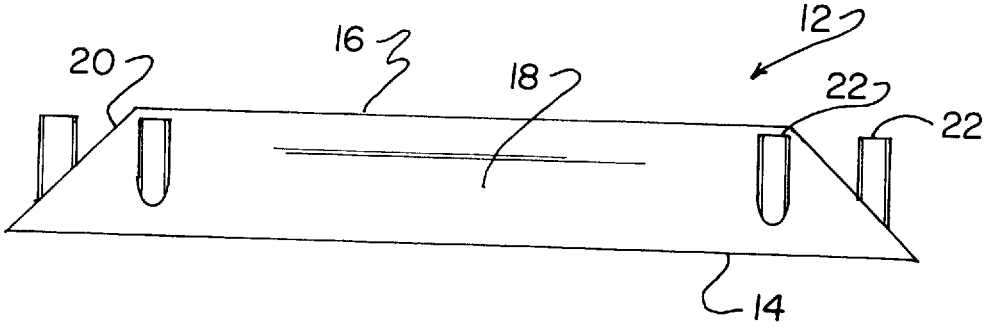
FIG. 4 is a side view of the base portion of the present invention.
Figure 5:
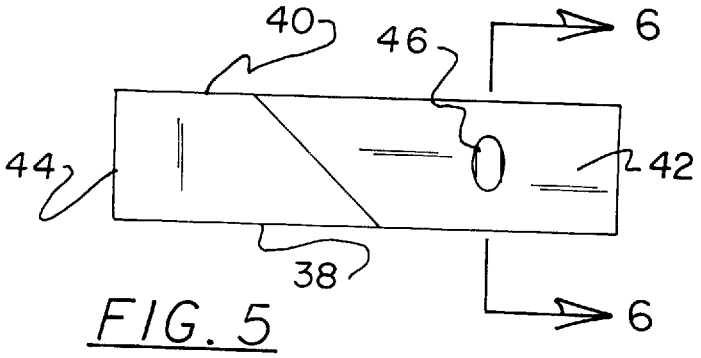
FIG. 5 is a side view of the L-shaped portion of the present invention.
Figure 6:
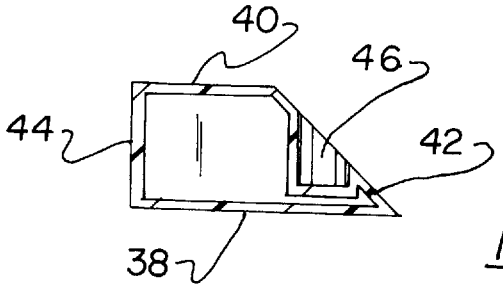
FIG. 6 is a cross-sectional view as taken along line 6—6 of FIG. 6.

With reference now to the drawings, and in particular, to FIGS. 1 through 6 thereof, the preferred embodiment of the new and improved adjustable foot rest embodying the principles and concepts of the present invention and generally designated by the reference number 10 will be described.

Specifically, it will be noted in the various Figures that the device relates to an adjustable foot rest for creating a foot rest of various heights and angles. In its broadest context, the device consists of a base portion, a T-shaped portion and at least one L-shaped portion. Such components are individually configured and correlated with respect to each other so as to attain the desired objective.

The base portion 12 has a generally rectangular configuration. The base portion 12 has a bottom wall 14 and a top wall 16. The base portion 12 includes angled opposed long side walls 18 and angled opposed short end walls 20. The long side walls 18 and the short end walls 20 are angled outwardly from the top wall 16 to the bottom wall 14. The short end walls 20 each have a pair of pegs 22 extending upwardly therefrom. One of the long side walls 18 has a peg 22 extending upwardly therefrom at opposite ends thereof.

The T-shaped portion 24 has a bottom wall 26 and a top wall 28. The T-shaped portion 24 has angled interior walls 30 and vertically disposed exterior walls 32. The angled interior walls 30 are angled outwardly from the top wall 28 to the bottom wall 26. The angled interior walls 30 each have peg receptacles 34 extending therein for mating with the pegs 22 of the base portion 12.

The L-shaped portion 36 has a bottom wall 38 and a top wall 40 and angled interior walls 42 and vertically disposed exterior walls 44. The angled interior walls 42 are angled outwardly from the top wall 40 to the bottom wall 38. The angled interior walls 42 each have peg receptacles 46 extending therein for mating with the pegs 22 of the base portion 12.

Figure 7:
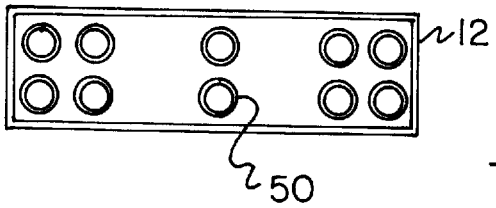
FIG. 7 is a bottom view of the base portion.

FIG. 7 is a bottom view of the base portion 12. As shown, the bottom base portion is planar and has a plurality of peg receptacles 50 formed therein. Such receptacles include two sets of receptacles each including four receptacles situated adjacent to ends of the base portion. Further, a pair of receptacles are situated at a central extent of the bottom of base portion. In the preferred embodiment, the base portion has a width of 12 inches and may be constructed with any one of various lengths. It should be noted that the top wall of the base portion has a non-skid surface formed therein.

Figure 8:
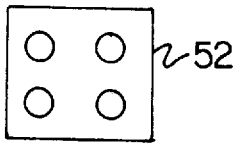
FIG. 8 is a top view of the end base portion.

As shown in FIG. 8, at least one end base portion 52 is provided with a square horizontal cross-section of a constant size along an entire height thereof. Such end base portion further has a top wall with four pegs formed therein. It should be noted that the surface area of the end base portion is 144 square inches. Further, the end base portion may be constructed with various heights.

Figure 9:
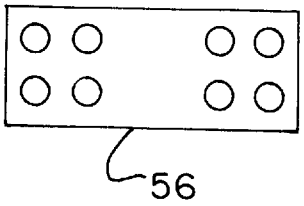
FIG. 9 is a top view of the connecting portion.
Figure 10:
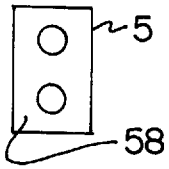
FIG. 10 is a top view of the auxiliary base portion.

FIG. 9 depicts a connecting portion 56 with a rectangular horizontal cross-section of a constant size formed along an entire height thereof. A top wall of the connecting portion is equipped with two sets of pegs each including four tightly spaced pegs situated adjacent to ends thereof. In the preferred embodiment, the top wall of the connecting portion has a length of about 24 inches and a width of about 12 inches. During use, the connecting portion functions for allowing the coupling of other portions thereto at various angles.

Finally, an auxiliary base portion 58 with a rectangular cross-section of a constant size along its entire height is provided with a top wall having a length of 6 inches and a width of 12 inches. The top wall is thus sized to accommodate a pair of pegs formed thereon and extending upwardly therefrom. Inclusion of the auxiliary base portion is critical for extra support when the base portion exceeds 4 inches in length.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable foot rest for creating a foot rest of various heights and angles comprising, in combination:

a base portion having a generally rectangular configuration, the base portion having a bottom wall and a top wall, the base portion including angled opposed long side walls and angled opposed short end walls, the long side walls and the short end walls being angled outwardly from the top wall to the bottom wall, the short end walls each having a pair of pegs extending upwardly therefrom, one of the long side walls having a peg extending upwardly therefrom at opposite ends thereof;

a T-shaped portion having a bottom wall and a top wall, the T-shaped portion having angled interior walls and vertically disposed exterior walls, the angled interior walls being angled outwardly from the top wall to the bottom wall, the angled interior walls each having peg receptacles extending therein for mating with the pegs of the base portion;

at least one L-shaped portion having a bottom wall and a top wall and angled interior walls and vertically disposed exterior walls, the angled interior walls being angled outwardly from the top wall to the bottom wall, the angled interior walls each having peg receptacles extending therein for mating with the pegs of the base portion; and at least one portion with a rectangular configuration of constant size and shape along an entire height thereof, the at least one portion further having a plurality of pegs formed in a top wall thereof.

2. An adjustable foot rest for creating a foot rest of various heights and angles comprising, in combination:

a base portion having a generally rectangular configuration, the base portion having a bottom wall and a top wall, the base portion including angled opposed long side walls and angled opposed short end walls, the long side walls and the short end walls being angled outwardly from the top wall to the bottom wall;

a T-shaped portion having a bottom wall and a top wall, the T-shaped portion having angled interior walls and vertically disposed exterior walls, the angled interior walls being angled outwardly from the top wall to the bottom wall, the T-shaped portion adjustably coupling with the base portion; and at least one L-shaped portion having a bottom wall and a top wall and angled interior walls and vertically disposed exterior walls, the angled interior walls being angled outwardly from the top wall to the bottom wall, the L-shaped portion adjustably coupling with the base portion.

3. The adjustable foot rest as set forth in claim 2 and further comprising corresponding male pegs and female peg receptacles for mating the base portion with the T-shaped portion and the L-shaped portion.

4. The adjustable foot rest as set forth in claim 2 and further including at least one portion with a rectangular configuration of constant size and shape along an entire height thereof, the at least one portion further having a plurality of pegs formed in a top wall thereof.

* * * * *